US009109277B2

(12) United States Patent
Zurecki et al.

(10) Patent No.: US 9,109,277 B2
(45) Date of Patent: Aug. 18, 2015

(54) METHOD AND APPARATUS FOR HEAT TREATING A METAL

(75) Inventors: Zbigniew Zurecki, Macungie, PA (US); Xiaolan Wang, Mt. Rainier, MD (US); Guido Plicht, Dortmund, DE (US); John Lewis Green, Palmerston, PA (US); Anna K. Wehr-Aukland, Macungie, PA (US)

(73) Assignee: Air Products and Chemicals, Inc., Allentown, PA (US)

( * ) Notice: Subject to any disclaimer, the term of this patent is extended or adjusted under 35 U.S.C. 154(b) by 0 days.

(21) Appl. No.: 13/338,742

(22) Filed: Dec. 28, 2011

(65) Prior Publication Data

US 2013/0008565 A1 Jan. 10, 2013

Related U.S. Application Data

(60) Provisional application No. 61/431,179, filed on Jan. 10, 2011.

(51) Int. Cl.

| | |
|---|---|
| ***C23C 8/30*** | (2006.01) |
| ***C23C 8/38*** | (2006.01) |
| ***C23C 8/32*** | (2006.01) |
| ***C23C 8/36*** | (2006.01) |
| *C23C 8/26* | (2006.01) |
| *C23C 8/20* | (2006.01) |

(52) U.S. Cl.

CPC ... *C23C 8/38* (2013.01); *C23C 8/30* (2013.01); *C23C 8/32* (2013.01); *C23C 8/36* (2013.01)

(58) Field of Classification Search

CPC ..... C23C 8/30; C23C 8/38; C23C 8/36; C23C 8/32

USPC ..... 148/215

See application file for complete search history.

(56) References Cited

U.S. PATENT DOCUMENTS

| | | | | |
|---|---|---|---|---|
| 4,035,203 | A | | 7/1977 | L'Hermite et al. |
| 4,175,986 | A | | 11/1979 | Ewalt et al. |
| 4,591,132 | A | | 5/1986 | Wunning |
| 5,055,260 | A | * | 10/1991 | Roberge et al. ..... 422/62 |
| 5,064,620 | A | | 11/1991 | Beuret |
| 5,139,584 | A | | 8/1992 | Gantois |
| 5,498,299 | A | | 3/1996 | Schmidt |

(Continued)

FOREIGN PATENT DOCUMENTS

| | | | |
|---|---|---|---|
| CN | 1281902 | A | 1/2001 |
| CN | 1847444 | A | 10/2006 |
| CN | 101187002 | A | 5/2008 |
| EP | 0353517 | | 7/1989 |
| GB | 2044804 | A | 10/1980 |

OTHER PUBLICATIONS

Cao et al. "Colossal carbon supersaturation in austenitic stainless steels carburized at low temperature", Acta Materialia, 51, 2003, 4171-4181.*

(Continued)

*Primary Examiner* — Rebecca Lee

(74) *Attorney, Agent, or Firm* — Rasaleen P. Morris-Oskanian; Amy Carr-Trexler

(57) ABSTRACT

Described herein is a method that can be used for heat treating a metal in at least one of the following processes: carburizing, carbonitriding, nitrocarburizing, and neutral carbon potential annealing operations that are used in a 1 atmosphere pressure furnace and in an atmosphere that is oxygen free and comprises nitrogen and at least one hydrocarbon.

4 Claims, 9 Drawing Sheets

(56) References Cited

U.S. PATENT DOCUMENTS

| | | | |
|---|---|---|---|
| 7,068,054 | B2 | 6/2006 | Chedid et al. |
| 2008/0149225 | A1 | 6/2008 | Connery et al. |
| 2008/0149226 | A1 | 6/2008 | Connery et al. |
| 2008/0283153 | A1 | 11/2008 | Zurecki et al. |

OTHER PUBLICATIONS

Zurecki, Z., et al.; "Atmosphere Carburizing using Electric Discharge-Activated Nitrogen-Natural Gas Mixtures"; 25th Heath Treating Society Conf. 2009; Sep. 14, 2009; pp. 135-142.

Marc Robert, Controlling decarburization/recarburization of nitrogen-hydrocarbon using a carbon flux method, Heat Treatment Tech. and Equip., vol. 12, No. 4, Jul. 1991, pp. 37-39.

Xinxin Lu, Controlling carbon potential with oxygen probe, Indus. Heating, No. 6, Dec. 1984, pp. 40-43.

Juge Tadayoshi, A Continuous gas carburizing furnace automatically controlled by using an oxygen probe, Heat Treat. of Metals, No. 12, Dec. 1981, pp. 26-30.

Marc, Robert., "Controlling Decarburization/Recarburization of Nitrogen—Hydrocarbon Using a Carbon Flux Method", Heat Treatment Technology and Equipment, vol. 12, Issue 4, pp. 37-39.

Lu, Xinxin, "Controlling Carbon Potential with Oxygen Probe", Industrial Heating, Issue 6, pp. 40-43.

* cited by examiner

METHOD AND APPARATUS FOR HEAT TREATING A METAL

CROSS-REFERENCE TO RELATED APPLICATIONS

This Application claims the benefit of U.S. Application No. 61/431,179 filed on Jan. 10, 2011. The disclosure of Application No. 61/431,179 is hereby incorporated by reference.

BACKGROUND OF THE INVENTION

Described herein are a method and an apparatus for heat treating and processing of metals, such as but not limited to steels, in a carbon-containing atmospheres. More specifically, described herein is a method and apparatus for carburizing, carbonitriding, nitrocarburizing, controlled carbon potential annealing, softening, brazing and sintering that may be conducted, for example, in a one atmosphere-pressure, batch or continuous furnace.

Conventional carbon-containing atmospheres are generated in endothermic and, sometimes, exothermic generators that are remote or external to heat-treating furnaces. The carbon-containing atmospheres are oftentimes adjusted to match processing requirements by mixing with one or more hydrocarbon gases (HC) such as methane ($CH_4$), propane ($C_3H_8$), propylene ($C_3H_6$), acetylene ($C_2H_2$), ammonia ($NH_3$), and/or nitrogen ($N_2$). Since endothermic gas reformed, most frequently, with air forms hydrogen ($H_2$), $N_2$, and carbon monoxide (CO), with minute quantities of water vapor ($H_2O$), and carbon dioxide ($CO_2$), the conventional atmospheres have a potential to oxidize alloying additions present in steel, e.g. chromium (Cr), manganese (Mn), silicon (Si) or vanadium (V) while, simultaneously, carburizing the main steel component, i.e., iron (Fe). The same oxidizing-carburizing effect takes place in other atmospheres such as dissociated alcohol atmospheres, e.g. $N_2$-methanol and $N_2$-ethanol.

The oxidizing-carburizing effect is undesired. In many instances, oxides located at the grain boundaries of metal weaken the surface and accelerate fatigue cracking or corrosion in the subsequent service. It is well recognized that countermeasures are costly, time, energy, and capital equipment intensive, and/or not available when carburizing thin wall steel components or net-shape surfaces. For carburizing treatments, these countermeasures may involve extending the carburizing cycle time in the furnace in order to develop an excessively thick carbon-rich layer in the metal surface and mechanical removal of the most external, oxide-affected portion of this layer in the following machining operations. In other treatments, the oxidizing-carburizing effect may deteriorate the surface appearance of annealed metal by forming spots of oxide films. Moreover, the oxidizing potential of these atmospheres may inhibit or completely prevent carburizing and the related, diffusional surface treatments of highly alloyed steels such as stainless steels and various types of tool steels and superalloys.

To avoid this oxidizing-carburizing effect, the metals industry may use oxygen-free atmospheres which, at the gas inlet to processing furnace, can contain technically pure $N_2$, $H_2$, $NH_3$, HC, and their combinations and mixtures, with optional argon or helium additions, but not air, CO, $CO_2$, $H_2O$ or alcohols and their vapors. It is well known that elimination of oxygen ($O_2$) containing gases from the furnace atmosphere, including air, CO, $CO_2$, $H_2O$, or alcohols and their vapors, is an effective solution to the problems outlined. This can be realized by using HC, HC—$N_2$, or HC—$H_2$ gas stream during low-pressure carburizing treatments in vacuum furnaces, where all air and moisture have been pumped out from the furnace volume in the preceding operations. The $O_2$-free, $N_2$—HC and $N_2$—$H_2$—HC atmosphere treatments have also been used with various degrees of success in the atmospheric (e.g., ambient, 1-atm pressure) furnaces. Here, the main complicating factor is a difficulty in excluding leakage of ambient air into the furnace. Although very popular and relatively inexpensive, the 1-atm-pressure furnaces cannot offer the level of atmosphere control found in vacuum furnaces. Additional factors encountered may include release of moisture from the ceramic refractory of the furnace and minor leaks of combustion flame from radiant heating tubes to the treatment space of furnace.

Carburizing process control in the conventional, endothermic and dissociated alcohol atmospheres containing oxygen is based on the equilibrium of the carburizing-decarburizing reaction on the surface of iron. The reducing potential of the atmosphere, associated with its carburizing potential can be measured with zirconia probes, frequently called oxygen or carbon probes. This process control method cannot be used with the $O_2$-free atmospheres described above because there is no equilibrium; the metal is carburized proportionally to the exposure time, temperature, and the flux or transfer of carbon-bearing species from the atmosphere to the surface. Here, the ultimate carburizing limit under the ordinary heat treatment conditions is the conversion of the substantial or entire metal volume into carbide by the HC-component of the atmosphere, which is an undesired outcome.

The most popular method of solving the process control challenge in vacuum furnaces involves a trial-and-error based development of carburizing recipes that regulate the mass flux of HC gas. The key variables involve the type of HC gas used, its flowrate, temperature, pressure, carbon boosting and diffusing time required for producing desired carbon concentration profile under the surface of the metal part, composition and total surface area of the parts treated. Since these variables can be precisely controlled, the number of trials needed to develop a particular recipe is small. Based on those recipes, the subsequent production runs can be automated and supported with popular computer-calculated diffusion models predicting in real-time the development of carbon concentration profile in metal.

The process control challenge is more difficult in the case of 1-atm-pressure furnaces which, as mentioned above, are less precise than vacuum furnaces and involve a number of additional, sometimes uncontrollable processing variables such as air and combustible gas leakage or moisture desorption. The development of recipes may require more trials than in the case of vacuum furnaces, and the carburizing cycle including carbon boost and diffuse may necessitate real-time, dynamic corrections to the processing parameters using some type of a feedback loop.

Various carbon flux probes, microbalance instruments and schemes have been developed over the years to address the challenges of process control in non-equilibrium as well as equilibrium atmospheres. Illustrative examples include those disclosed in the following references: U.S. Pat. Nos. 4,035,203; 4,591,132; 5,064,620; 5,139.584; and 7,068,054; EP Pat. No. 0353517A2; and U.S. Publ. No. 2008/0149225A1. U.S. Pat. No. 7,068,054 describes a sensor probe, measurement system and measurement method for directly measuring solute concentration profiles in conductive material components at elevated processing temperatures. US Publ. No. 2008/0149225 provides a method of treating a metal part in an atmospheric pressure furnace using an oxygen free controlled gas. Their applicability to non-equilibrium atmosphere carburizing in 1-atm-pressure furnaces is, nevertheless, limited, as well as the reliability and lifetime of carbon-flux probes in industrial, non-stop production environments.

Accordingly, there is a need in the art to provide a method and/or apparatus to enable or improve the development of process recipe and the subsequent dynamic control when no suitable carbon flux probe is available and/or when the continuous use of the probe in the non-equilibrium atmosphere used poses reliability problems.

BRIEF SUMMARY OF THE INVENTION

Described herein is a method and apparatus that can be used for heat treating a metal in at least one of the following processes: carburizing, carbonitriding, nitrocarburizing, controlled carbon potential annealing, softening, brazing and sintering that may be conducted, for example, in a one atmosphere-pressure, batch or continuous furnace and in an atmosphere that is oxygen free and comprises nitrogen and at least one hydrocarbon.

In one aspect, there is provided a method for controlling the atmosphere in a furnace wherein the pressure of the furnace comprises 1 atmosphere and wherein no oxygen or oxygen-containing gases are added, comprising the steps of: treating a metal part in a 1 atmosphere pressure furnaces and in an atmosphere comprising a hydrocarbon gas wherein a modified metal coupon method is used for determining a carbon flux from the atmosphere into the metal part and diffusion calculations are obtained for carbon concentration profile at and under the surface of the metal part. In this method, the carbon flux measurements were made using average measurements obtained from metal coupon probes.

In another aspect, there is provided a method for controlling the atmosphere in a furnace wherein the pressure of the furnace comprises 1 atmosphere and wherein no oxygen or oxygen-containing gases are added, comprising: treating a metal part in a 1 atmosphere pressure furnaces and in an atmosphere comprising a hydrocarbon gas wherein a carburizing recipe is developed using carbon flux measurements and correlating them with at least one measure comprising the amount of $H_2$ in an effluent of the furnace and optionally a voltage reading from a zirconia probe, and controlling an amount of the hydrocarbon gas in the atmosphere during the subsequent processing steps. In one particular embodiment, the method further comprises: operating a zirconia probe comprising a zirconia cell in the atmosphere with no oxygen or oxygen containing gases added intentionally. In this method, the carbon flux measurements were made using the actual measurements obtained.

In any of the above aspects, the treating step is at least one process selected from carburizing, carbonitriding, nitrocarburizing, controlled carbon potential annealing, softening, brazing and sintering. In any of the above aspects, the method can be performed on a metal part that is selected from common, plain and low-alloy steels, high alloy steels, tool steels, stainless steels and superalloys. In any of the above aspects, the treating step can be conducted using electric plasma discharge activation methods of the treatment atmosphere.

In a further aspect, there is provided an apparatus for controlling treatment of a metal part, the apparatus comprises a modified metal coupon apparatus involving thick metal probes for determining carbon flux from atmosphere into metal allowing for subsequent diffusion calculations for carbon concentration profile at and under metal surface in the metal heat treatment atmosphere process in 1-atm-pressure furnaces involving non-equilibrium atmospheres containing hydrocarbon gases with no intentional additions of oxygen or gases containing oxygen.

BRIEF DESCRIPTION OF SEVERAL VIEWS OF THE DRAWINGS

In FIGS. 1*a* and 1*b*, 'T' is temperature, 't' is carburizing time, 'C' is carbon concentration, 'W' is width, 'X' is depth, 'J' is carbon flux, and 'D' is carbon diffusivity at 'T' or temperature.

In FIGS. 2*a* and 2*b*, 'L' is length, 'C' is carbon concentration, 'W' is width, 'x' is gap distance, 'J' is carbon flux, 't' is carburizing time, '2W' is thickness, and 'D' is outer diameter.

DETAILED DESCRIPTION OF THE INVENTION

Figure 1:
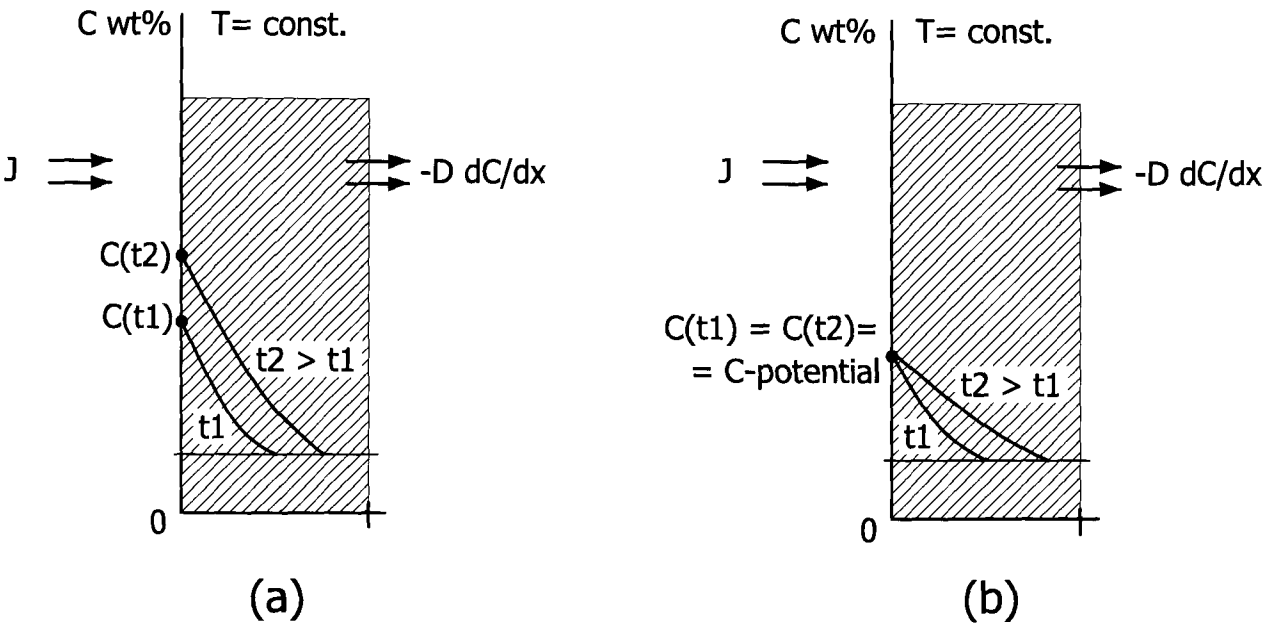
FIG. 1 provides a comparison of the carbon profile evolution in equilibrium (FIG. 1*b*) and non-equilibrium (FIG. 1*a*) atmosphere carburizing processes.

The method described herein can be used for estimating carbon flux into steel during carburizing operations in non-equilibrium atmospheres, e.g. oxygen-free, $N_2$—HC gas carburizing at 1 atm pressure, or in an alternative embodiment, carburizing under HC or $H_2$—HC gas blends. The same method can be used for carburizing, carbonitriding, nitrocarburizing, controlled carbon potential annealing, softening, brazing and sintering that may be conducted, for example, in a one atmosphere-pressure, batch or continuous furnace. At least one objective of the method described herein is to facilitate the development of new carburizing process recipes when suitable, real-time carbon flux probe or in-furnace microbalance and diffusion controllers are not available.

The term "oxygen free" as used herein describes atmospheres wherein no oxygen or oxygen containing gas is intentionally added to the furnace atmosphere; however, minor amounts of oxygen (e.g., 1% by volume percentage or below) may be present incidentally from entry or exits of the furnace, or from reduction of metals oxides and refractory ceramics present inside the furnace, and/or oxygen and moisture desorbed from furnace walls. Examples of intentionally added to the furnace atmosphere $O_2$-containing gases include air, CO, $CO_2$, $H_2O$, or alcohols and their vapors. The most popular, $O_2$-containing atmospheres are endothermic atmospheres which contain approximately 20 volume percent (vol %) CO, 40 vol % $H_2$, trace levels of $CO_2$ and $H_2O$, and the balance of $N_2$. Unless otherwise specified herein, the sum of all vol % equals 100 vol %. When enriched by the addition of HC for the purpose of carburizing steel, these atmospheres may, typically, include less than 10 vol % HC, less than 1 vol % $CO_2$, and less than 2 vol % $H_2O$ of the overall vol %. Examples of intentionally added to the furnace atmosphere $O_2$-free gases include HC, $H_2$, $N_2$, $NH_3$ and their blends such as HC—$N_2$, HC—$H_2$ and $N_2$—$H_2$—HC. Typically, these atmospheres contain less than 15 vol % HC (HC partial pressure is below 0.15 atm), with the balance of $N_2$ and/or $H_2$. Examples of intentionally formed non-equilibrium furnace atmospheres include HC, HC—$N_2$, HC—$H_2$ and $N_2$—$H_2$—HC as well as their combinations with $NH_3$ and noble gases: argon (Ar) and helium (He). These atmospheres are the same as the $O_2$-free atmospheres described above. Examples of intentionally formed equilibrium furnace atmospheres include CO, CO—$CO_2$, CO—$H_2$, CO—$CO_2$—$H_2$, CO—$CO_2$—$H_2$—$H_2O$, and their derivatives or combinations containing, also, $N_2$, Ar, He, alcohol, $NH_3$, and air or $O_2$. These atmospheres are, essentially, the same atmospheres as the endothermic atmospheres described above. It is understood, that these atmospheres can be produced by external or in-furnace reforming of methane, propane, butane, dissociating methanol, ethanol, and mixing the products with the other listed gases: $N_2$, $H_2$, $NH_3$, HC, Ar, and/or He. It is also understood that 1 (one) atmosphere pressure furnace is the furnace without special provisions for operation at very low or very high pressure such as the well known, high gas-pressure quenched vacuum furnaces used for heat treating of metals and ceramics. The 1 atmosphere pressure furnace operates at, approximately, the same as or slightly higher pressure than the pressure of ambient air in the furnace surroundings. These slight pressure variations may be a function of one or more of the following: weather, geographic location, the system of seals or curtains used in the furnace, furnace temperature, furnace atmosphere gas composition, and/or the total inlet gas flowrate related to the furnace volume, furnace exhausts, and uncontrolled leakage openings. In any case, these pressure variations may amount to less than 0.2 atm (or 0.2 barg or 20.2 kPa or 2.94 psig or 152 torr).

In certain embodiments, the method described herein may be used to monitor a carburization process involving a non-equilibrium atmosphere for carburization control in a system that uses a gas control panel to control the flow and mixing of a specific gas mixture and deliver that specific gas to the 1 atm pressure furnace. In one particular embodiment of a typical carburization process, a specific gas comprising nitrogen gas and hydrocarbon gas in prescribed concentrations is delivered to the 1 atm furnace as a function of time and temperature and other process parameters. The gas atmosphere within the furnace may be substantially oxygen free, with very small quantities of oxygen present as a result of leakage, impurities, etc. User inputs may include results or analysis from test samples from the furnace during the calibration and operation of the furnace. Preferably, such results or analysis may include actual carbon uptake realized in the furnace at certain atmosphere and/or other conditions. In addition to the foregoing, other sensed or measured processing parameters including furnace temperature as measured with a temperature sensor or thermocouple, $H_2$ concentration in the furnace effluent gases, and furnace reducing potential as measured with an oxygen (zirconia) probe, may also be monitored and controlled by the end-user.

A carburization model which is controlled by the end-user via a control panel, CPU or other means, can be used to calculate processing inputs as a function of time. In certain embodiments, the carburization model uses a software program fed with selected inputs, including user's inputs, furnace temperature, furnace atmosphere reducing potential, as well as known parameters such as alloy composition, furnace type, etc. to calculate or ascertain the desired inlet gas concentrations and flowrates as a function of heat treatment time. During the actual carburization process, one or metal parts to be carburized are loaded into an atmospheric pressure furnace and contacted with the prescribed gas mixtures for a certain duration of time. Once heat treated, the treated metal parts are removed from the furnace and placed in a cooling or quench chamber. The cooling or quench chamber may also comprise an atmosphere that is $O_2$-free so as to further minimize oxidation. Alternatively, the treated metal part or parts may be cooled inside the furnace. The ranges for processing conditions for the 1-atmosphere pressure treatments in the scope of the disclosed method can be vary, so that the following examples listed below can merely illustrate just a few applications. Thus, stainless steel metal parts can be high-temperature carburized and carbonitrided using $N_2$—$H_2$—HC—$NH_3$ atmospheres within the temperature range of from 700° C. to 1150° C. Here, the volumetric concentrations of component gases may vary within the following ranges: $H_2$ from 0% to 99.75%, $N_2$ from 0% to 99.75%, HC from 0.25% to 10%, and $NH_3$ from 0% to 99.75% by volume. Treatment times may vary from 1 hour to 48 hours. Using the same compositions, stainless steel metal parts can be also low-temperature carburized, carbonitrided or nitrocarburized. Here, the temperature may range from about 350° C. to about 580° C., and the typical treatment time could be as short as 30 minutes or as long as 72 hours. Mild steels, alloyed steels, and tool steel parts can be carburized between 840° C. and 1000° C.; the treatment time may range from 15 minutes to 12 days depending on the metal load used and the carbon profile desired. Nitrocarburizing and carbonitriding of these steel parts can be carried out between 450° C. and 750° C., and the atmosphere compositions will be the same as those listed above for stainless steels. Many sintering atmospheres may include 0%-98% $N_2$, 0%-99.75% $H_2$, and 0.25%-5% HC by volume, and the temperature in the continuous sintering furnaces could range from 18° C. to, typically, 1250° C. In alternative embodiments, broader treatment times, temperatures, and/or gas composition ranges may also be used for the process.

FIG. 1 provides an illustration of the main difference between the non-equilibrium, oxygen-free, $N_2$—HC gas carburizing and the conventional carburizing in endothermic-type, equilibrium atmospheres comprising CO, $H_2$, $N_2$ and hydrocarbon enrichment gases. In FIG. 1*a*, representing non-equilibrium atmospheres, both the surface carbon concentration and the carburized depth increase simultaneously with the carburizing time. In FIG. 1*b*, the surface carbon concentration is fixed at the level of so-called equilibrium carbon potential (Cp) so that an increasing carburizing time increases the carburized depth only. However, in both FIG. 1*a* and 1*b*, carbon diffusion from the surface into steel core is based upon the same mechanism in both the nonequilibrium and the equilibrium atmosphere, namely Fick's law, $J=-DdC/dX$, where: D is carbon diffusivity controlled by temperature, steel composition, and local carbon concentration, C is carbon concentration, and X is depth under surface. This means that for a test coupon having a width 'W', the diffusion carbon flux 'J' can be correlated with the surface carbon concentration and the rate of the carbon transfer from the atmosphere as long as the opposite side of the coupon has not been carburized.

Metal coupon, metal foil or, shim stock methods for determining Cp are known and used in the conventional, equilibrium atmosphere carburizing operations. Since the surface carbon concentration cannot exceed Cp, the typical method involves a very thin steel foil and a relatively long exposure time in order to saturate metal throughout and achieve a constant carbon concentration profile across the width. Consequently, the measurement of weight gain of the foil directly indicates atmosphere Cp. However, applying this procedure for determining Cp when a non-equilibrium, oxygen-free, $N_2$-hydrocarbon gas atmosphere is used would result in a complete conversion of the metal into carbide, i.e., no useful information about the time dependant carbon flux needed for controlling the process. In this regard, the method described herein, in one aspect, provides a metal coupon procedure where only one side is exposed to the carburizing atmosphere. The coupon thickness or width 'W' and carburizing time T are selected in such a way that the unexposed coupon side is not yet carburized by the flux of carbon atoms flowing from the exposed side. When comparing to the conventional metal foil procedure, the coupon width or thickness is larger and the exposure time typically is comparable to or shorter. It is believed that the weight gain of a relatively thick coupon is directly correlated with the rate of the carbon transfer from the atmosphere to the surface metal parts treated and the carbon flux from the surface to the core which is not inhibited by increasing carbon concentration on the opposed, unexposed side.

Figure 2:
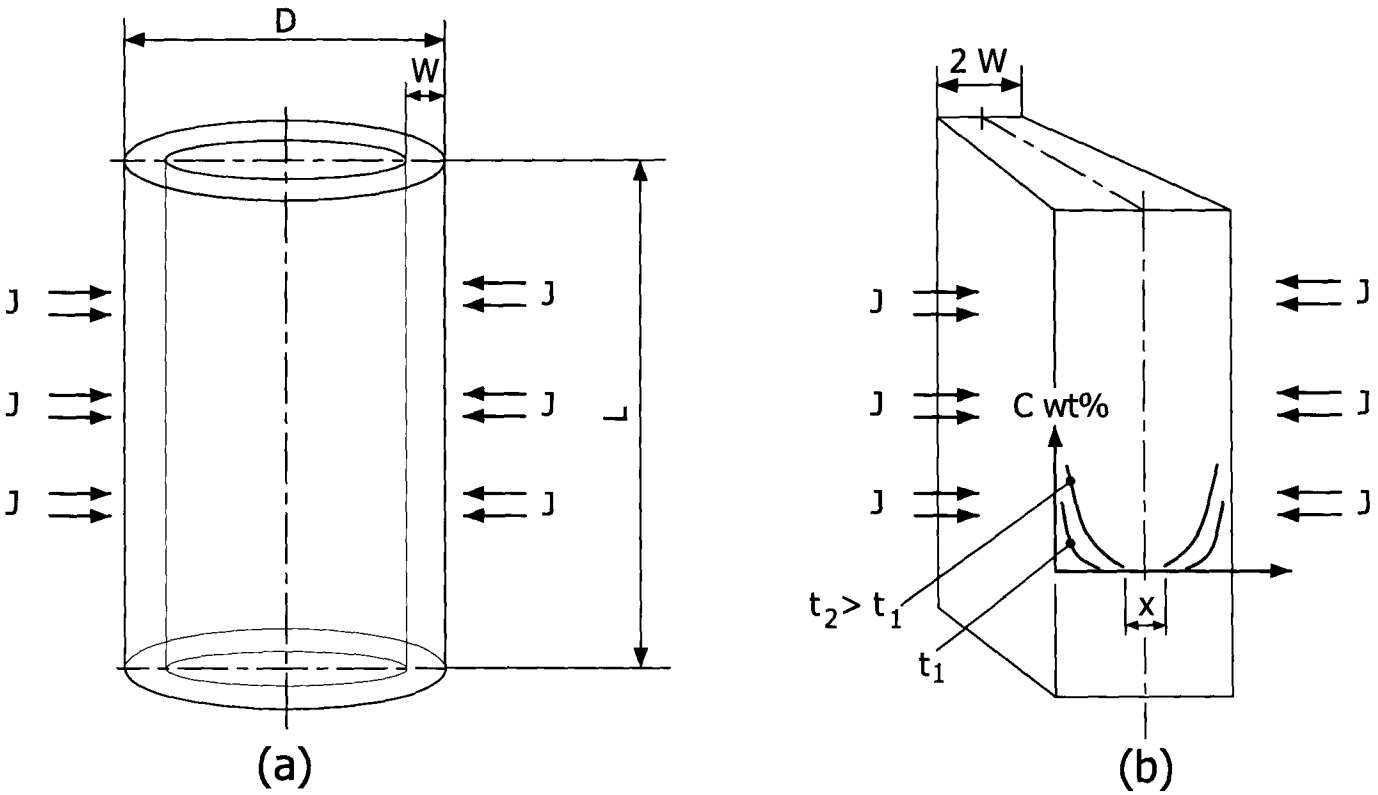
FIG. 2 provides examples of two configurations for modified metal coupon probes suitable for 1-sided (FIG. 2*a*) and 2-sided (FIG. 2*b*) exposures to carburizing atmospheres.

FIG. 2*a* exemplifies one of many possible configurations of metal coupon that may be used: steel tubing which is snapped on a solid rod or supporting pipe which prevents carburizing of the internal diameter surface. For typical carburizing conditions, the following dimensions can be used: L=100 mm, OD=10 mm, W=0.5 mm. The exposed surface is about 31.4 $cm^2$, starting weight is about 11.7 grams, and anticipated carbon weight gain may range between 2 and 80 mg making weight measurements easy using conventional (offline) microbalances. Alternative coupon geometries, FIG. 2*b*, may involve 2-sided carburizing but the thickness of those coupons must be doubled in order to prevent carbon enrichment in the middle of the coupon at the end of carburizing exposure. What is important for the accurate operation of the 2-sided metal coupon as a carbon mass flux probe is selecting its thickness, 2W, in such a way that the gap, X, between the carburized zones (FIG. 2*b*), expanding from both sides, is more than zero. Since the rate of expansion of the carburized zones is a function of temperature, atmosphere composition and mixing, as well as composition of the metal coupon used, and the probe may be used for shorter or longer lasting measurements, some additional trial and error testing may be required for selecting the best value of 2W, if the carburizing conditions and/or furnace differ significantly from the most commonly used carburizing conditions encountered in the commercial heat treating operations.

Figure 3A:
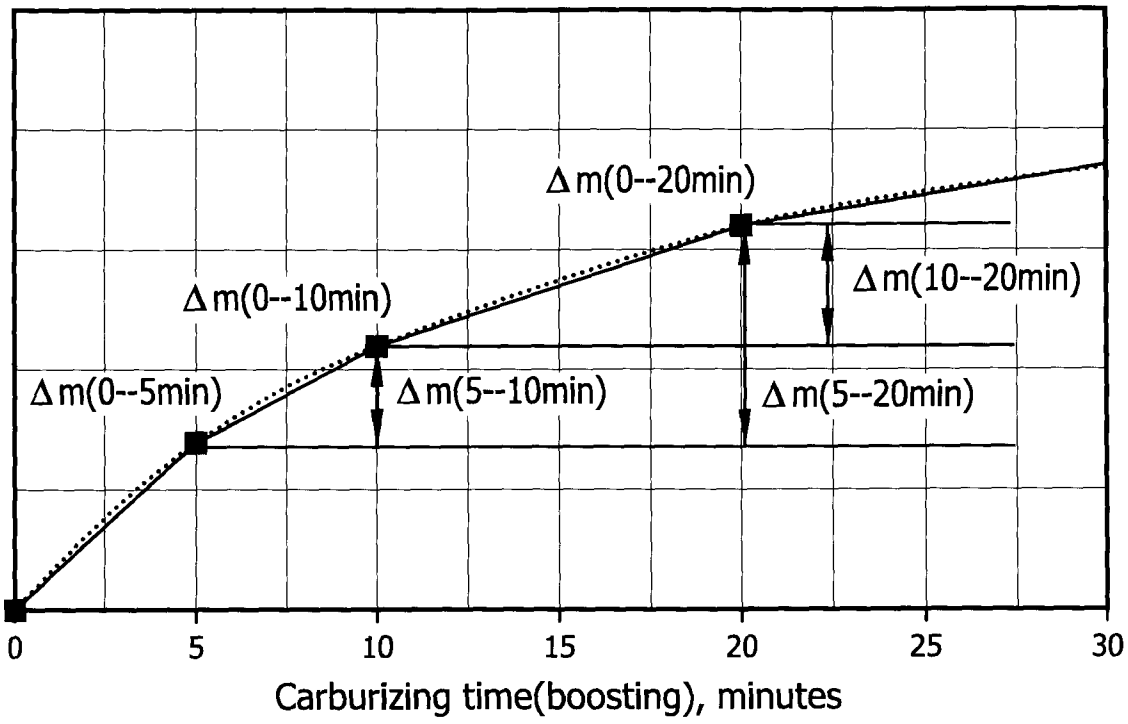
FIG. 3*a* through FIG. 3*c* provides an estimation of the average carbon flux using modified metal coupon probes.

Proposed carbon flux measurements can be realized using the conventional shim stock probe ports found in all furnaces running carburizing operations. The procedure requires sticking a few metal coupons into furnace for a few different, precisely measured periods of time and measuring the weight gain as a function of exposure time. Thus, one probe with one coupon can be inserted to furnace for 5 minutes, another probe with another coupon for 10 minutes and, yet another probe for 20 minutes. The weight gain of each coupon can be reported as the average carbon flux for the exposure time used. FIG. 3*a* shows the typical weight gains registered by 3 metal coupons or steel foil exposed to the carburizing atmosphere for 5, 10, and 20 minutes. In FIG. 3*a*, the temperature, atmosphere, and mixing was kept constant. The line connecting the weight gain datapoints measured reflects the decreasing rate in view of increasing carbon concentration at the coupon surface. The Δm value obtained during the 5 minute exposure, i.e. Δm (0-5 min), is the average gain associated with the middle of the exposure time, i.e., t1'=t*1/2=5 minutes/2=2.5 minutes measured in grams. The same operation can be repeated for the longer exposure times, but it should be noted that the longer the exposure time is, the larger error results from associating the average gain with the half of the exposure time used. However, an additional, more accurate data can be extracted from the 3 measurements made by observing that the weight gain after 10 minute exposure minus weight gain after 5 minute exposure can be attributed to the time equal 7.5 minutes. Also, the net gain between the time points 10 minutes and 20 minutes, i.e. the gain after 20 minute exposure, Δm (0-20 min) minus the gain after 10 minute exposure, Δm (10-20 min), can be associated with the time point of 15 minutes. Since the number of combinations available from these 3 measurements is 6, the number of experimentally obtained datapoints doubles.

Figure 3B:
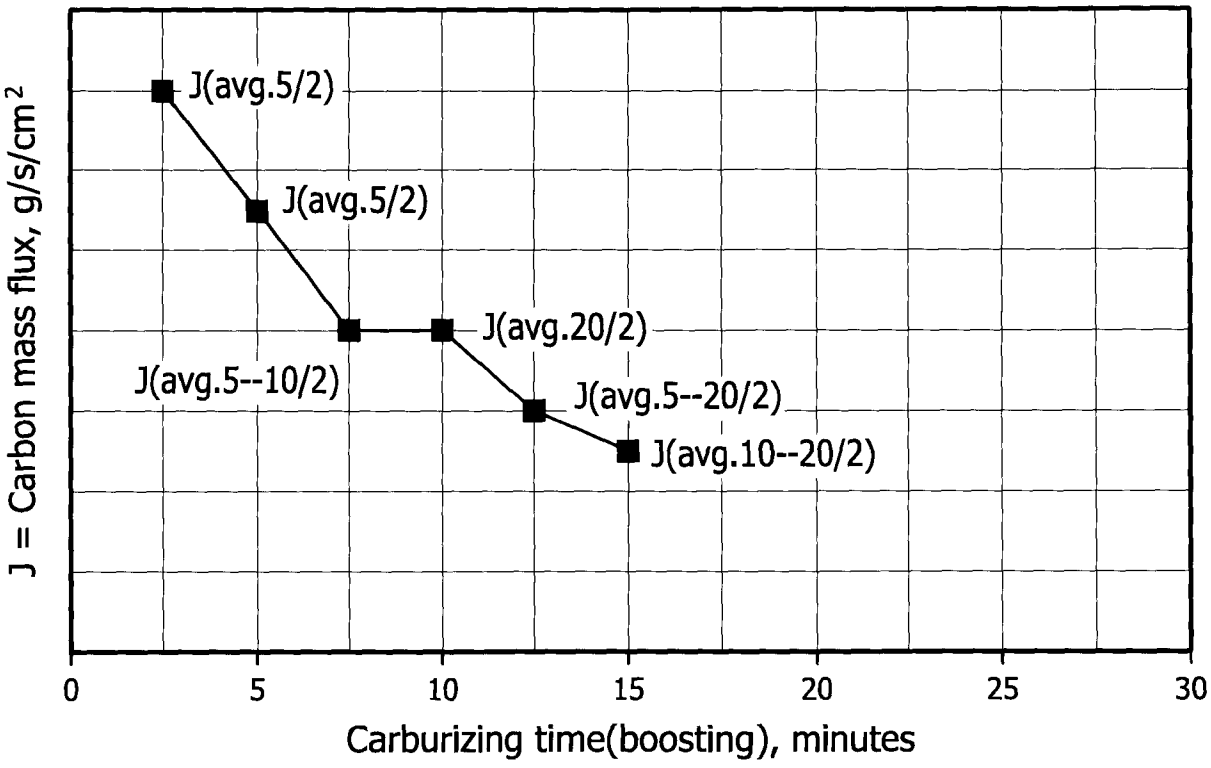

Carbon mass flux, J, is calculated by dividing weight gain Δm by coupon surface area exposed to the atmosphere, A, and by the exposure time interval, t, (J=Δm/A/t) which means that the measured datapoints can be quickly converted into carbon flux values. FIG. 3*b* shows the carbon fluxes recalculated from the weight gains (shown in FIG. 3*a*) resultant from the three original measurements using the procedure of extracting the additional data described above. Like in FIG. 3*b*, the temperature, atmosphere composition, and mixing was kept constant. The general formulas for calculating the fluxes from the three weight gain measurements are listed in Table 1, where: t1, t2, and t3 are exposure times, Δm1, Δm2, and Δm3 are the gains at the end of each exposure time, t' times are the times assigned for specific weight gains, and J are the averaged flux values associated with the t' times. It should be understood that the described method may involve fewer or more measurements than the three measurements detailed here.

TABLE 1

Calculation of average carbon fluxes for exposure times

| Data used | Time | Carbon flux |
|---|---|---|
| $t_1$, $\Delta m_1$ | $t'_1 = \frac{t_1}{2}$ | $J(t'_1) = \frac{\Delta m_1}{A \cdot t_1}$ |
| $t_2$, $\Delta m_2$ | $t'_2 = \frac{t_2}{2}$ | $J(t'_2) = \frac{\Delta m_2}{A \cdot t_2}$ |
| $t_1$, $t_2$, $\Delta m_1$, $\Delta m_2$ | $t'_{1\sim2} = \frac{t_1 + t_2}{2}$ | $J(t'_{1\sim2}) = \frac{\Delta m_2 - \Delta m_1}{A \cdot (t_2 - t_1)}$ |
| $t_3$, $\Delta m_3$ | $t'_3 = \frac{t_3}{2}$ | $J(t'_3) = \frac{\Delta m_3}{A \cdot t_3}$ |
| $t_1$, $t_3$, $\Delta m_1$, $\Delta m_3$ | $t'_{1\sim3} = \frac{t_1 + t_3}{2}$ | $J(t'_{1\sim3}) = \frac{\Delta m_3 - \Delta m_1}{A \cdot (t_3 - t_1)}$ |
| $t_2$, $t_3$, $\Delta m_2$, $\Delta m_3$ | $t'_{2\sim3} = \frac{t_2 + t_3}{2}$ | $J(t'_{2\sim3}) = \frac{\Delta m_3 - \Delta m_2}{A \cdot (t_3 - t_2)}$ |

Figure 3C:
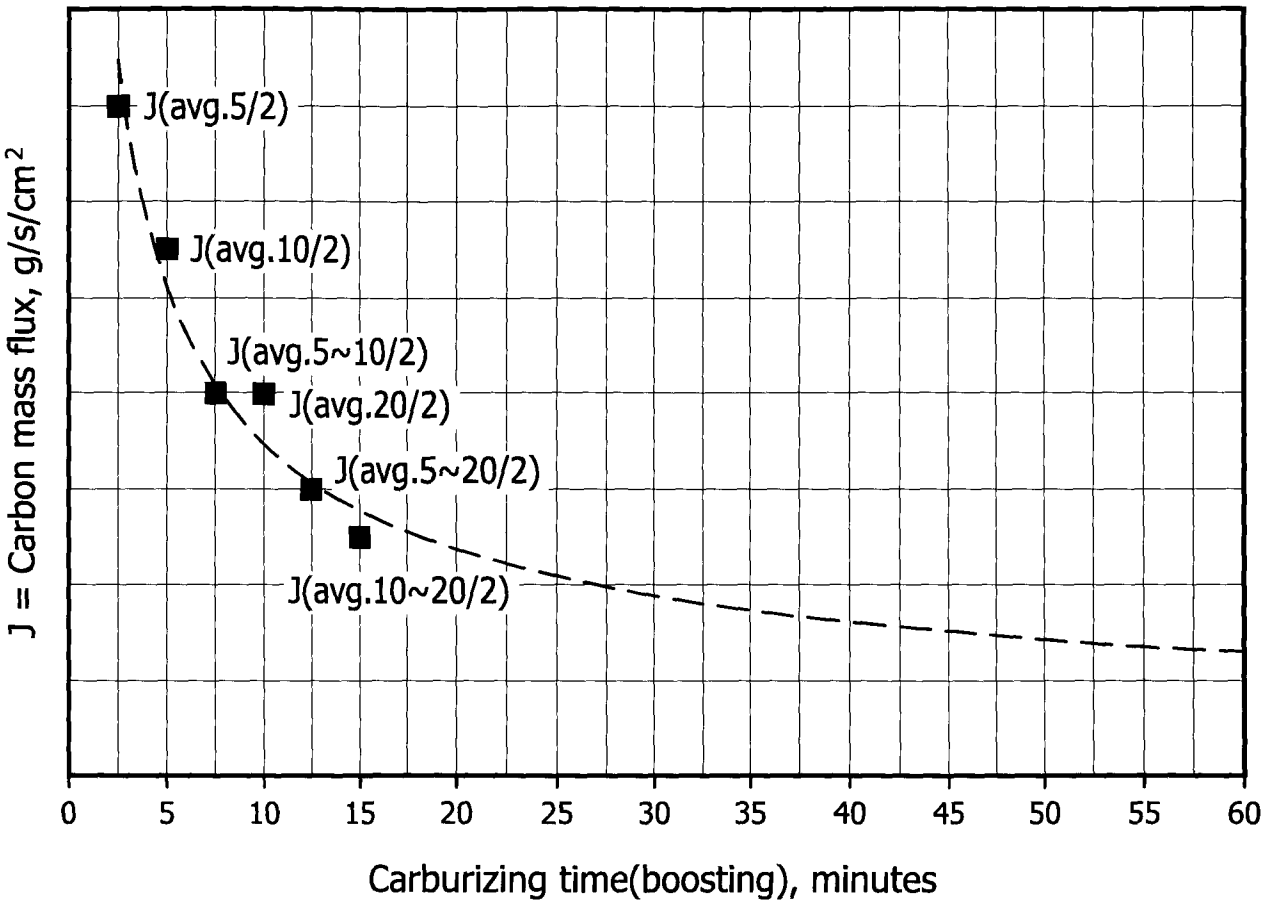

Using an off-line calculation spreadsheet, the six J-flux datapoints can be fitted with a power function curve of the general type: $J=at^b$, since carbon flux into metal core typically decays during carburizing and C-saturation according to such a relationship, reflecting the characteristics of lattice diffusion of carbon and/or diffusion across a carbide reaction layer. Here, a and b are constants, and t is running time of the carburizing (boosting) cycle. Thus, a general function of J(t) is $J=at^b$ wherein a and b are trend constants, $0<1<10^{-5}$, $b<0$, and t-time in minutes. FIG. 3*c* shows the curve fitting obtained. Like in FIGS. 3*a* and 3*b*, in FIG. 3*c*, the temperature, atmosphere composition, and mixing was kept constant. The fitted curve represents time dependant flux value and, in the next step, can be extrapolated up to the maximum carburizing time of interest, e.g. to 60 minutes, if 60 minutes was the original boosting time intended for the analyzed operation. Thus, in the next step, the average flux for the 60 minute boosting can be calculated using the same, offline computer spreadsheet by averaging the value integrated under this fitted curve.

Industrial carburizing treatments involve, typically, carbon boosting step or steps, when carbon flux and/or carbon potential is high, and carbon diffusing step or steps, when carbon flux and/or carbon potential is lower. This method accommodates the boosting-and-diffusing procedures by the way of utilizing a diffusional modeling software program, capable of predicting carbon diffusion during the treatments from the surface into the metal core. In this aspect of the method described herein, an offline diffusion software package, or "CarbTool" software from the Worcester Polytechnic Institute, Worcester, Mass. 01609, may be used to evaluate the diffusing time needed to obtain a desired carbon profile for the average boosting flux estimated in FIG. 3*a* through FIG. 3*c*. The software package can aid in adjusting total boosting and diffusing time-intervals necessary to achieve the desired carbon profile for this or other embodiments of the method described herein. It should be noted here that if the carbon flux during boosting is excessively high, and if its estimation through the steps described above takes a relatively longer time, the total mass of carbon boosted into the metal would too large for the carbon case depth required, and the subsequent adjustment in diffusing time can only correct the final surface carbon concentration to the desired one but not the carbon case depth which may, in certain embodiments, turn out to be excessively deep. In contrast to the vacuum furnace carburizing process which can completely eliminate air leakage, a 1-atm-pressure furnace typically has to deal with either a smaller or larger air leakage. Consequently, the diffusing step may, in certain embodiments, use some positive, non-zero carbon flux that would mitigate against the detrimental effects of the air leakage. Thus, flux can be realized by reducing the original (boosting) HC flow rate to a small fraction, e.g. 0.25-0.5 vol % HC in $N_2$ during diffusing as opposed to 1.0-2.0 vol % HC during boosting. The estimation of C-flux during diffusing can be realized using the same procedure as the one described herein for boosting. In alternative embodiments, the method described could avoid the need for a repetitive flux estimate, if, for example, other gas analytical instruments monitoring furnace atmosphere do not indicate significant changes in the furnace effluents or significant increase of oxidizing species, e.g. $H_2O$ and $CO_2$ due to, for example, leakage.

Described above modified metal coupon procedure is based on the assumption that the atmosphere and other carburizing process conditions do not depart significantly from the desired values through the boosting and diffusing steps. In certain embodiments, this assumption may be valid but, however, needs to be monitored as the carburizing process progresses. The key variability factors during the process involve atmosphere and temperature which may be monitored using conventional gas analyzers and thermocouples or zirconia probes operated according to the method disclosed hereinafter. The other factors, e.g., work load surface area or mixing, are set at the beginning of carburizing process and require adjustments only from one process cycle to another.

Figure 4:
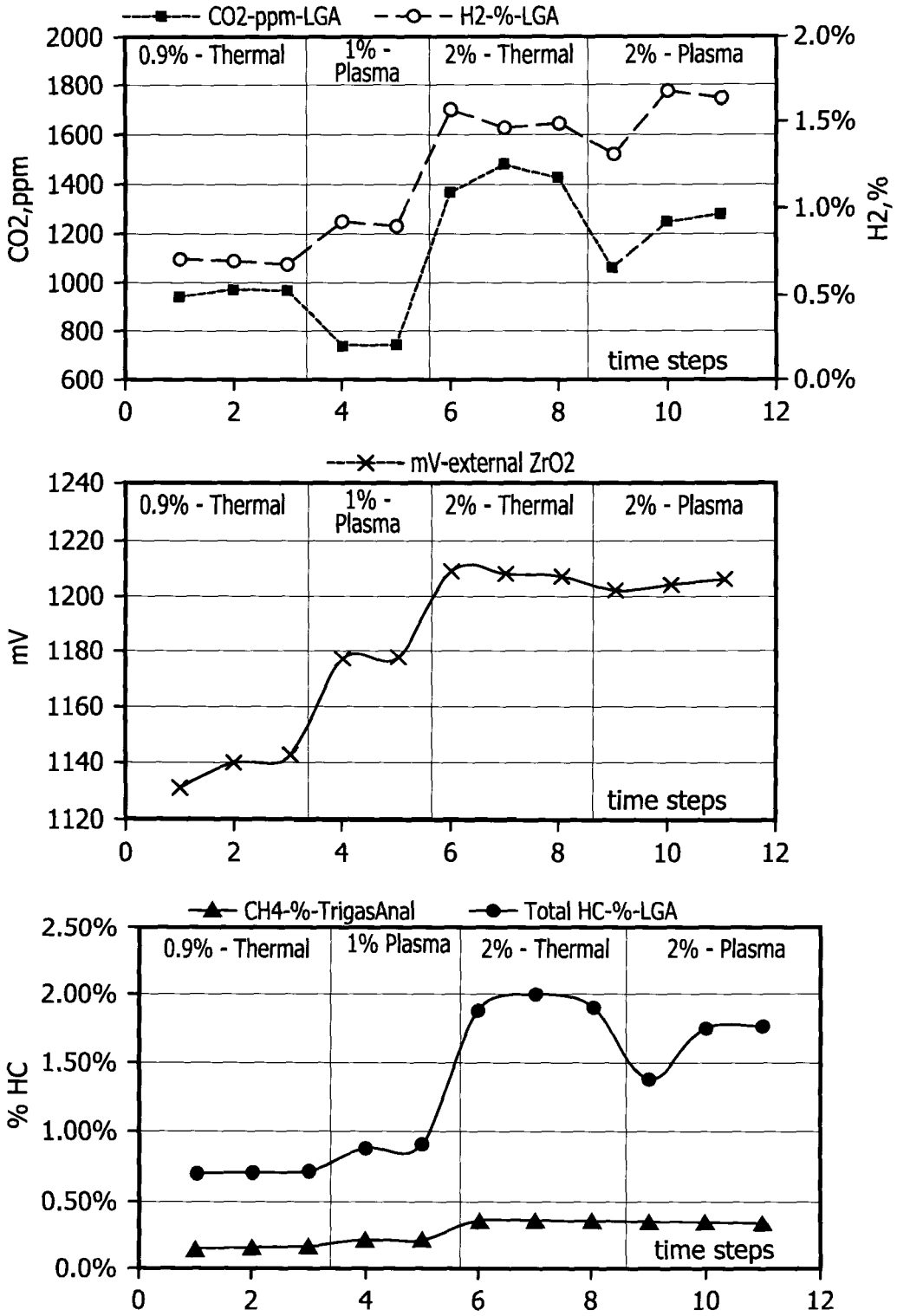
FIG. 4 provides various correlations between effluent gases and external zirconia probe readings during carburizing tests involving the following atmospheres: $N_2$-0.9% $C_3H_8$, $N_2$-2% $C_31H_8$, $N_2$-2% $C_3H_8$ atmospheres at 930° C. using conventional, thermal-only activation, and $N_2$-2% $C_3H_8$ atmospheres at 930° C. using plasma activation.

In one particular embodiment, monitoring $H_2$ concentration in the furnace effluent while carburizing steel under oxygen-free, $N_2$-hydrocarbon atmospheres is an effective process control measure. In alternative embodiments, monitoring the concentration of other effluents, e.g. $H_2O$, $CO_2$, CO, or $CH_4$ may also be useful; however, in certain instances, the changes in concentration of these effluents may not be as significant and/or as easy to measure for steel surface carburizing as that of $H_2$. Table 2 shows the correlation between carburizing steel surface and $H_2$ concentration as a function of numerous process variables. Table 2 shows that there are 3 areas where increasing $H_2$ effluent may signalize a drop in carburizing. Thus, if $H_2$ effluent is monitored throughout the entire ($1^{st}$) carburizing cycle, dedicated to the recipe development and involving carbon flux measurements, then the next carburizing cycles could be executed solely on the basis of $H_2$-readings, and all lesser adjustments of the carburizing atmosphere could involve modification of the inlet hydrocarbon concentration in order to match the pre-recorded $H_2$ concentration at any particular moment (minute) of the repeated cycle. FIG. 4 shows that, except for the difficult to resolve residual hydrocarbon effluents, the other process indicators change to measurement error or parts per million (ppm) range.

In certain embodiments, the 1 atmosphere (atm)-pressure, carburizing or controlled carbon potential industrial furnaces using the conventional, equilibrium atmospheres such as endothermic atmospheres can be equipped with 'in-situ' zirconia ($ZrO_2$) probes called, also, oxygen probes or carbon probes. The term in-situ means that the sensing tip of the zirconia probe is located directly in the furnace atmosphere and at the furnace temperature. The electromotive force measured by these probes in millivolts (mV) can be associated with the carburizing potential of equilibrium ($O_2$-containing) atmospheres as shown in FIG. 1*b* as C(t1)=C(t2)=$C_{-potential}$. These conventional carburizing atmospheres are based on equilibria between oxygen in the oxygen containing atmosphere gases and hydrogen as well as, CO, $CO_2$, $H_2O$, $H_2$, and HC. Conventionally, all the zirconia probes use pure air as the reference gas on the opposite side to the sampling side of $ZrO_2$ membrane. At equilibrium, redox reactions can be associated with specific electromotive force due to the difference in the oxidizing potential between the reference (air) and sampling (furnace atmosphere) sides of the zirconia membrane. In addition, the activity and solubility of carbon in steel or iron at equilibrium with CO and $CO_2$ can be determined by analyzing the austenitic field in the well known Fe—C binary diagram. Consequently, zirconia probes can be used to determine carbon potential (Cp) or the iron surface carbon in the CO—$CO_2$—$H_2O$—$H_2$—HC atmospheres where the CO disproportionation is responsible for metal carburizing and HC additions are used to restore CO in the atmosphere. The problem with the use of zirconia probes starts when the sampled atmosphere, e.g., $O_2$-free, non-equilibrium atmosphere, contains no oxygen in a free or bound form, i.e., $CO_2$, $H_2O$, or CO, or if the concentration of these gases in the sampled atmosphere is negligible vis-à-vis strongly reducing gases: HC and $H_2$. Such a high reducing potential may result in reducing of the very $ZrO_2$ sensor material, i.e., in removing some of oxygen from the ceramic lattice, which may lead to electronic readout errors. The voltage limit of the most commonly used zirconia probes nears −1250 mV (or +1250 mV in the reversed probe configuration) in the most frequently used carburizing temperatures. This limit is exceeded when the $O_2$-free, non-equilibrium atmosphere replaces the conventional equilibrium atmospheres which contain CO along with, frequently, elevated $H_2O$ and $CO_2$ levels. This may render the conventional, in-situ zirconia probes ineffective for certain embodiments. It is additionally observed that the electromotive force readings in oxygen-free, $N_2$—$H_2$ and $N_2$—HC atmospheres could also reach similar, high values even though the carburizing potential of these blends may be very different: zero in the $1^{st}$ case and thermodynamically unlimited in the $2^{nd}$. This effect also renders zirconia probes ineffective as the sole tool to determine carburizing potential in the $O_2$-free, non-equilibrium atmospheres in certain embodiments. However, if the zirconia probe was used as a reducing potential sensor, the zirconia probe may be a useful tool for monitoring the carburizing process in these atmospheres in a manner similar to the $H_2$ gas monitoring described above.

The method described herein provides, among other things, three ways to solve the problem of the high voltage limitation in order to enable zirconia probe operation in the $O_2$-free, non-equilibrium atmospheres: [1] reducing the temperature of the zirconia cell to below the carburizing temperature of the furnace, [2] replacing the air reference gas inside the probe with an inert gas containing a known, negligible quantity of $O_2$, e.g: 5 or 10 ppm $O_2$, or [3] a combination of [1] and [2]. All these solutions are based on the Nernst equation predicting the electromotive force change in response to the changes in zirconia cell temperature (T in Kelvin degrees) and/or the $O_2$ partial pressure in the reference gas ($P_{reference}$ partial pressure, a molar fraction of $O_2$ at 1 atm-pressure):

$$E=0.0496T\log(P_{sample}/P_{reference})$$

where: $P_{sample}$ is the partial pressure of $O_2$ or its equivalent reduction oxidation (redox) potential in the furnace's gas sample. Table 3 illustrates the zirconia probe readings (in millivolts) for various levels of $O_2$ in gas sample at 1 atm-pressure as a function of cell temperature (600° C. and 900° C.) and the partial pressure of $O_2$ on the reference side of the cell (air=0.209 atm=20.9 vol % at 1 atm-pressure, 0.001 atm=0.1 vol % at 1 atm-pressure, and 0.00001 atm=10 ppm $O_2$ at 1 atm-pressure). Table 3 shows that reducing the cell temperature but, also, the $O_2$ partial pressure on the reference side of the cell enables the increase of the millivolt output to above −1250 which is acceptable in the case of the most commonly used industrial zirconia probes. In the reversed zirconia probe configurations which use $P_{reference}/P_{sample}$ ratio to measure mV, the same method reduces the output to below +1250 mV. FIG. 4 shows the mV readings of an external zirconia probe in the $P_{reference}/P_{sample}$ configuration in the $O_2$-free, non-equilibrium atmosphere. In contrast to in-situ probes, external probes could regulate the temperature of $ZrO_2$ cell. The external zirconia cell was kept at the temperature reduced to 700° K even though the carburizing atmosphere was 930° C. Air reference gas was used in this test, but the reduction in the temperature was able to decrease the voltage readings to below +1210 mV, even though these readings would tend to exceed +2000 mV at the actual carburizing temperature, corrupting the output signal and, possibly, damaging the cell in the process.

Using the low-$O_2$ reference gas in $ZrO_2$ probe, the industrial operators may continue to use their in-situ zirconia probes to supervise the carburizing process in the $O_2$-free, non-equilibrium atmospheres, even without the capability of determining the carbon potential or flux into the metal. Just like in the case of using the $H_2$-analysis of furnace effluents, the changes in mV readings are not always proportional to the change in metal carburizing effect. Table 2 shows the correlations between carburizing steel surface and mV readings as a function of numerous process variables. The trends are somewhat different than for the $H_2$ concentration changes, and the combination of mV readings and $H_2$ concentration is only partly complementary. Nevertheless, if both $H_2$ effluent and mV are monitored throughout the entire ($1^{st}$) carburizing cycle, dedicated to the recipe development and involving carbon flux measurements, then the next carburizing cycles could be executed solely on the basis of those readings, and all lesser adjustments of the carburizing atmosphere could involve modification of the inlet hydrocarbon concentration in order to match the pre-recorded $H_2$ and mV values at any particular moment (minute) of the repeated cycle. Thus, $H_2$ and mV readings could be used, individually or in combination, to supervise production runs and apply process corrections, as needed, by modifying the inlet HC concentration.

TABLE 2

Effect of process parameters in 1-atm-pressure furnace carburizing of steel under oxygen-free, $N_2$-hydrocarbon atmospheres on $H_2$ emission, zirconia voltage readings, and carburizing effectiveness

| No. | Increasing process parameter | Effect on metal carburizing effect | $H_2$ concentration in furnace exhaust gas | Zirconia probe mV reading |
|---|---|---|---|---|
| 1 | Furnace preconditioning time under carburizing atmosphere | increases | Increases | increases |
| 2 | Oxygen-containing feed gas impurities ($CO_2$, $H_2O$) | decreases | Decreases | decreases |
| 3 | Heavy hydrocarbon-containing feed gas impurities (C6+) | increases | Decreases | increases |
| 4 | Air leakage into furnace | decreases | Decreases | decreases |
| 5 | Oxidized or wet steel load and/or furnace fixtures | decreases | Decreases | decreases |
| 6 | Hydrocarbon concentration in feed gas ($N_2$-hydrocarbon mix) | increases | Increases | increases |
| 7 | Furnace temperature during carburizing (boosting) | increases | Increases | increases |
| 8 | Feed gas activation by electric plasma discharge | increases | Increases | varies |
| 9 | Surface area of steel parts loaded to furnace | decreases | Increases | decreases |
| 10 | Boosting time if all other parameters are kept constant | decreases | Decreases | varies |

TABLE 2-continued

Effect of process parameters in 1-atm-pressure furnace carburizing of steel under oxygen-free, $N_2$-hydrocarbon atmospheres on $H_2$ emission, zirconia voltage readings, and carburizing effectiveness

| No. | Increasing process parameter | Effect on metal carburizing effect | $H_2$ concentration in furnace exhaust gas | Zirconia probe mV reading |
|---|---|---|---|---|
| 11 | Residence time of $N_2$-hydrocarbon atmosphere inside furnace (opposite to feed gas flowrates) | decreases | Increases | varies |
| 12 | Atmosphere mixing by electric fan during carburizing | increases | Increases | varies |

TABLE 3

Effect of zirconia cell temperature and $O_2$ partial pressure in the reference gas on millivolt output readings
Effect of zirconia cell temperature and oxygen content of reference gas on mV−readings for the same gas sample. Readings below −1200 mV are undesired.

| O2 in gas sample or an oxidizing potential equivalent of reducing gas blend sampled | | | T zirconia cell deg. C.: | | | | | |
|---|---|---|---|---|---|---|---|---|
| | | | 600 | 900 | 600 | 900 | 600 | 900 |
| | | | Reference gas O2 | | | | | |
| % at 1 atm | p. press. | ppm at 1 atm | 0.209 | 0.209 | 0.001 | 0.001 | 0.00001 | 0.00001 |
| 1.0000 | 0.01000 | 10000 | −57.2 | −76.8 | 43.3 | 58.2 | 129.9 | 174.5 |
| 0.1000 | 0.00100 | 1000 | −100.5 | −135.0 | 0.0 | 0.0 | 86.6 | 116.4 |
| 0.0100 | 0.00010 | 100 | −143.8 | −193.2 | −43.3 | −58.2 | 43.3 | 58.2 |
| 0.0010 | 0.00001 | 10 | −187.1 | −251.3 | −86.6 | −116.4 | 0.0 | 0.0 |
| 1.0E−04 | 1.0E−06 | 1.0E+00 | −230.4 | −309.5 | −129.9 | −174.5 | −43.3 | −58.2 |
| 1.0E−06 | 1.0E−08 | 1.0E−02 | −317.0 | −425.9 | −216.5 | −290.9 | −129.9 | −174.5 |
| 1.0E−08 | 1.0E−10 | 1.0E−04 | −403.6 | −542.3 | −303.1 | −407.3 | −216.5 | −290.9 |
| 1.0E−09 | 1.0E−11 | 1.0E−05 | −446.9 | −600.4 | −346.4 | −465.4 | −259.8 | −349.1 |
| 1.0E−10 | 1.0E−12 | 1.0E−06 | −490.2 | −658.6 | −389.7 | −523.6 | −303.1 | −407.3 |
| 1.0E−11 | 1.0E−13 | 1.0E−07 | −533.5 | −716.8 | −433.0 | −581.8 | −346.4 | −465.4 |
| 1.0E−12 | 1.0E−14 | 1.0E−08 | −576.8 | −775.0 | −476.3 | −640.0 | −389.7 | −523.6 |
| 1.0E−13 | 1.0E−15 | 1.0E−09 | −620.1 | −833.2 | −519.6 | −698.2 | −433.0 | −581.8 |
| 1.0E−14 | 1.0E−16 | 1.0E−10 | −663.4 | −891.3 | −562.9 | −756.4 | −476.3 | −640.0 |
| 1.0E−15 | 1.0E−17 | 1.0E−11 | −706.7 | −949.5 | −606.2 | −814.5 | −519.6 | −698.2 |
| 1.0E−16 | 1.0E−18 | 1.0E−12 | −750.0 | −1,007.7 | −649.5 | −872.7 | −562.9 | −756.4 |
| 1.0E−18 | 1.0E−20 | 1.0E−14 | −836.6 | −1,124.1 | −736.1 | −989.1 | −649.5 | −872.7 |
| 1.0E−19 | 1.0E−21 | 1.0E−15 | −879.9 | −1,182.2 | −779.4 | −1,047.3 | −692.8 | −930.9 |
| 1.0E−20 | 1.0E−22 | 1.0E−16 | −923.2 | −1,240.4 | −822.7 | −1,105.4 | −736.1 | −989.1 |
| 1.0E−21 | 1.0E−23 | 1.0E−17 | −966.5 | −1,298.6 | −866.0 | −1,163.6 | −779.4 | −1,047.3 |
| 1.0E−22 | 1.0E−24 | 1.0E−18 | −1,009.8 | −1,356.8 | −909.3 | −1,221.8 | −822.7 | −1,105.4 |
| 1.0E−23 | 1.0E−25 | 1.0E−19 | −1,053.1 | −1,415.0 | −952.6 | −1,280.0 | −866.0 | −1,163.6 |
| 1.0E−24 | 1.0E−26 | 1.0E−20 | −1,096.4 | −1,473.1 | −995.9 | −1,338.2 | −909.3 | −1,221.8 |

$E = 0.0496 \times T[K] \times \log(P\ sample/P\ reference)$
where: P—partial pressure of gas
Note:
0.209 = air reference;
900 C. = typical carburizing temperature The method described herein for determining carbon flux during carburizing in non-equilibrium atmospheres using the carbon flux probe or the modified metal coupon technique and the subsequent $H_2$-effluent, and/or optional mV monitoring according to the procedure involving reduced cell temperature or reference $O_2$ concentration may be also applied, for example, to fine-tune and control atmospheres used in neutral carbon potential annealing in other types of furnaces, such as, but not limited to, batch and continuous furnaces, as well as other types of operations, such as but not limited to, carbonitriding and nitrocarburizing, softening, brazing, and sintering. Further, in certain embodiments, the method described herein may be applicable to thermal carbon-containing atmospheres. In alternative embodiments, the method described herein can be used in atmospheres involving an additional electric activation in form of plasma discharges such as that disclosed, for example, in U.S. Publ. No. 2008/10283153 A1 which is incorporated herein by reference in its entirety.

Also described herein are carburizing recipe development steps using a carbon-flux probe and auto-controller system performing real-time diffusional calculations if available (FIG. 5) and carburizing recipe development steps using the modified metal coupon probe and offline diffusion calculator described herein in FIG. 1 through 3 and FIG. 6. In both cases, referring to FIGS. 5 and 6, the initial, mass-balance based, rough calculation of hydrocarbon (HC) and nitrogen ($N_2$) flowrates (step 2) that is required for the conditioning of the treatment furnace and the next processing steps should factor in the total surface area of metal load, the total mass of carbon that needs to be diffused into metal load, and the time-window available for the carburizing cycle. Since not all carbon introduced into furnace as HC gas is absorbed by the load, the mass balance calculation should assume a conservatively low value for carbon recovery from the HC gas introduced, e.g. 5 to 10 vol % for $CH_4$ and 15 to 25 vol % for the heavier hydrocarbons. Not known a priori, the carbon recovery value may differ with furnace configuration, internal atmosphere mixing, air leakage, or other factors. Repeated recipe trials provide the most reliable basis for improving the accuracy of carbon recovery factor in mass-balance calculations, but the criticality of these values may be minimized after completing the $1^{st}$ recipe trial and acquiring the carbon flux data that can be used directly for HC-level adjustments and the diffusional control of the process.

Figure 5:
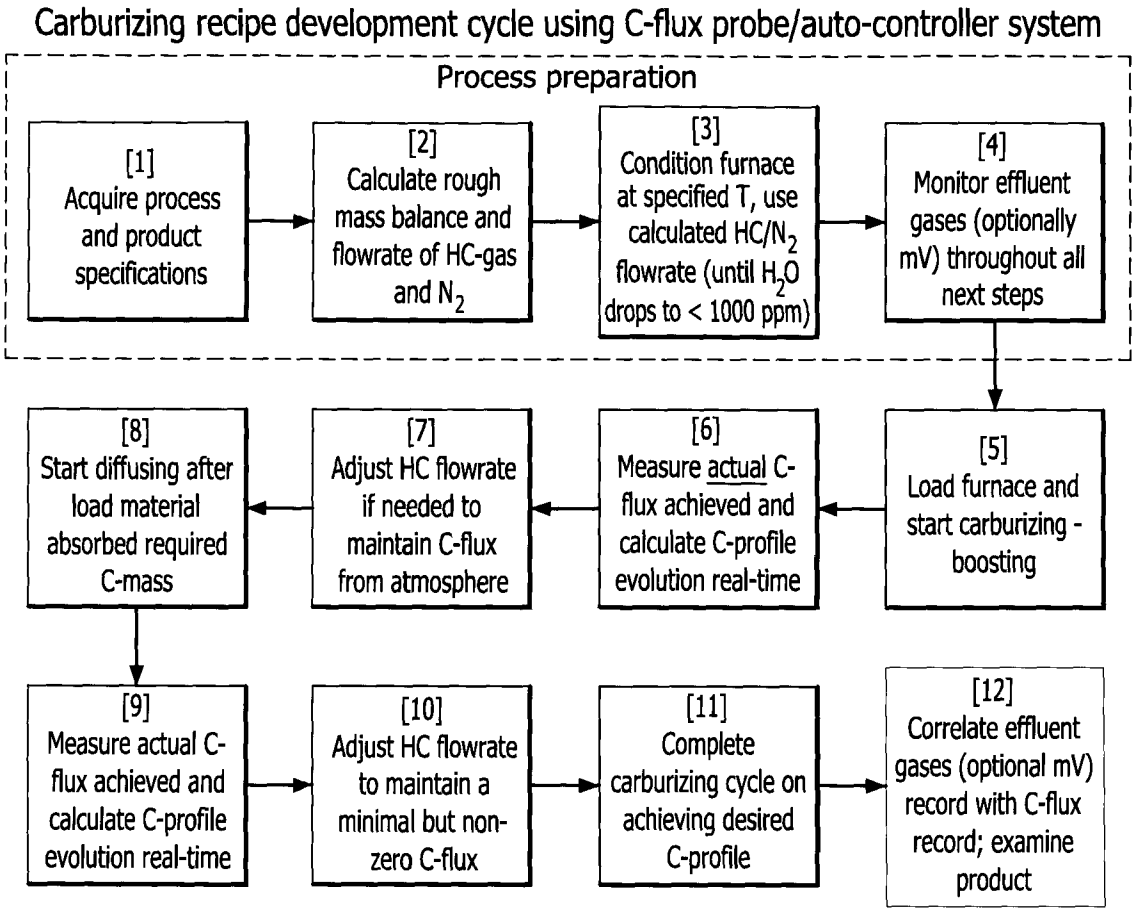
FIG. 5 provides an exemplary method for carburizing comprising, among other things, a carbon flux probe and an automatic diffusion controller.

In the method described in FIG. 5, the method comprises the following steps: acquire process and product specifications (e.g., calculate rough mass balance and flowrate of hydrocarbon (HC)-gas and nitrogen ($N_2$), condition furnace at the specified temperature using the calculated HC/$N_2$ flowrate (until $H_2O$ drops to <1000 ppm), monitor effluent gases and optionally mV throughout all subsequent process steps), load furnace with metal parts and begin carburizing/boosting, measure the actual C-flux achieved using a carbon flux probe, and calculate the carburizing profile real-time, adjust the HC flow rate if needed to maintain C-flux from atmosphere, start diffusing after load material or metal parts absorbed required C-mass, measure actual C-flux achieved and calculate carburizing profile (C-profile) real-time, adjust HC flowrate to maintain a minimal but non-zero C-flux in order to mitigate against oxygen, complete carburizing cycle on achieving desired C-profile, correlate effluent gases (and optionally mV changes as measured by zirconium probe) with C-flux record and examine metal part by scanning electron microscopy (SEM) or other means for microhardness or other property.

Figure 6:
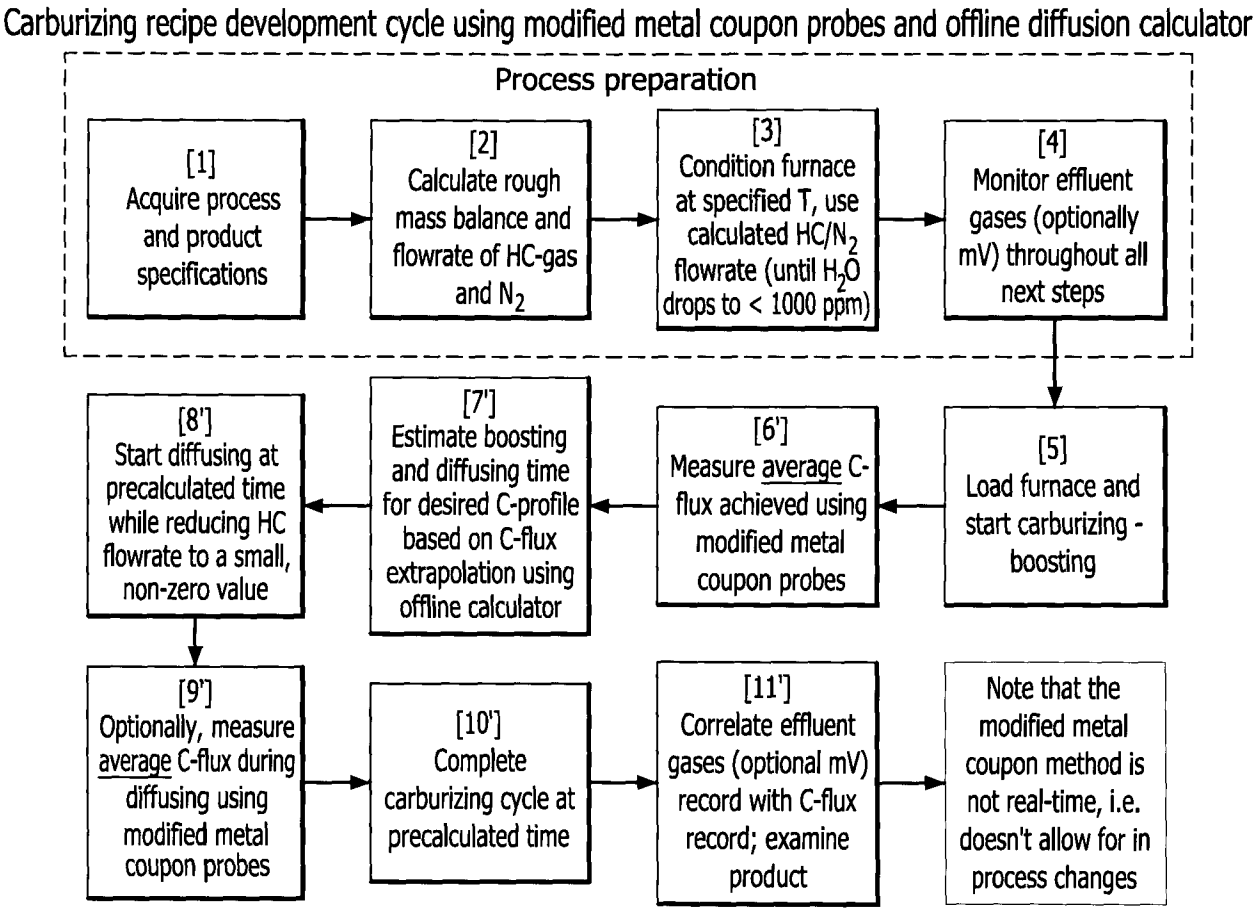
FIG. 6 provides an exemplary method for carburizing comprising, among other things, modified metal coupon probes and an offline diffusion calculator FIG. 7 provides an embodiment for adopting certain process conditions in production related to the process steps identified in FIG. 5 and FIG. 6.

In the method described in FIG. 6 (which unlike the method described in FIG. 5 is not real-time) the method comprises the following steps: acquire process and product specifications (e.g., calculate rough mass balance and flowrate of hydrocarbon (HC)-gas and nitrogen ($N_2$), condition furnace at the specified temperature using the calculated HC/$N_2$ flowrate (until $H_2O$ drops to <1000 ppm), monitor effluent gases and optionally mV throughout all subsequent process steps)), load furnace with metal parts and begin carburizing/boosting, measure the average C-flux achieved using a metal coupon (e.g., remove metal coupon and measure mass weight), estimate boosting and diffusing time for desired C-profile based on C-flux extrapolation using an offline calculator, central processing unit (CPU) or other means, start diffusing at precalculated time while reducing HC flowrate to a small, non-zero value, optionally measure average C-flux during diffusing using a metal coupon, complete carburizing cycle at pre-calculated time, correlate effluent gases (and optionally mV changes as measured by zirconium probe) with C-flux record and examine metal part by scanning electron microscopy (SEM) or other means for microhardness or other property.

Figure 7:
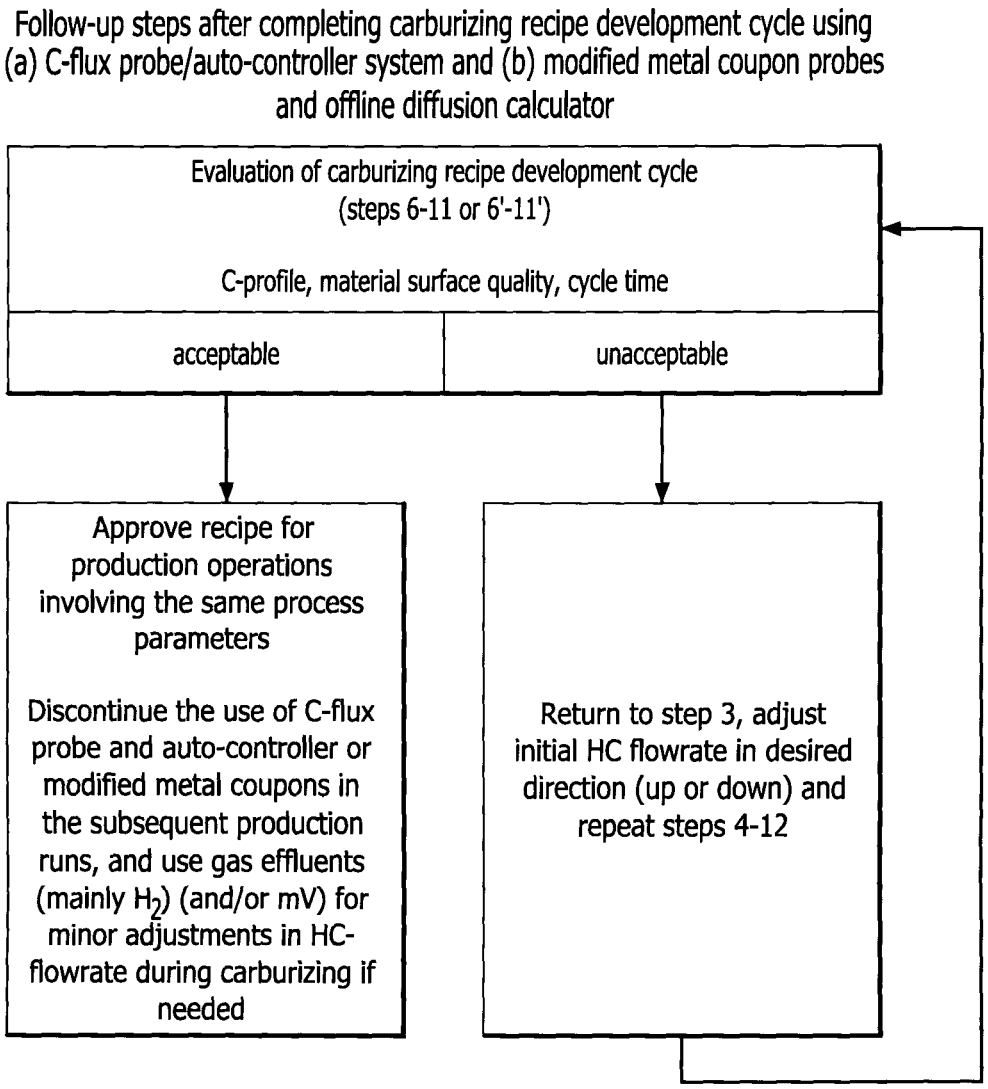

FIG. 7 represents the recipe decision loop for adopting development process conditions in production operations using only $H_2$ effluent monitoring and, optionally, zirconia probe operated according to the method disclosed above, and the other gas effluent monitoring as process indicators for adjusting HC input in real-time during the carburizing process.

We claim:

1. A method for controlling an atmosphere in a furnace wherein the pressure of the furnace is 1 atmosphere, no oxygen or oxygen-containing gases are added, and the atmosphere is a non-equilibrium atmosphere, the method comprising the steps of:

treating a metal part in a 1 atmosphere pressure furnace and in an atmosphere comprising a hydrocarbon gas wherein a metal coupon is exposed to the furnace atmosphere to determine a carbon flux from the atmosphere into the metal part and average diffusion calculations are obtained for carbon concentration profile at a surface and under the surface of the metal part;

wherein either:

(a) only one side of the metal coupon is exposed to the furnace atmosphere and the thickness of metal coupon and length of exposure to the furnace atmosphere are selected such that an unexposed side of the coupon is not carburized at the end of the exposure time, or (b) both sides of the metal coupon are exposed to the furnace atmosphere and the thickness of metal coupon and length of exposure to the furnace atmosphere are selected such that the thickness of a gap between carbon enriched zones expanding from each side of the coupon as a result of the exposure is greater than zero at the end of the exposure time.

2. The method of claim 1 where the treating step is at least one process selected from carburizing, carbonitriding, nitrocarburizing, controlled carbon potential annealing, softening, brazing and sintering.

3. The method of claim 1 wherein the metal part is selected from plain and low-alloy steels, high alloy steels, tool steels, stainless steels and superalloys.

4. The method of claim 1 wherein the treating step involves electric plasma discharge activation methods of the treatment atmosphere.

* * * * *